US006076431A

United States Patent [19]

Vasudeva

[11] Patent Number: 6,076,431

[45] Date of Patent: Jun. 20, 2000

[54] STRIKING TOOLS WITH DEFLECTOR GRIPS

[75] Inventor: Kailash C. Vasudeva, Waterloo, Canada

[73] Assignee: Maxtech, Inc., Roseville, Mich.

[21] Appl. No.: 09/110,141

[22] Filed: Jul. 6, 1998

Related U.S. Application Data

[63] Continuation-in-part of application No. 08/796,066, Feb. 4, 1997, abandoned.

[51] Int. Cl.[7] ..... B25C 3/00

[52] U.S. Cl. ..... 81/44; 30/167

[58] Field of Search ..... 81/44; 30/167, 30/168, 295, 358

[56] References Cited

U.S. PATENT DOCUMENTS

| | | |
|---|---|---|
| 628,455 | 7/1899 | French . |
| 4,133,362 | 1/1979 | Kolloch et al. . |

FOREIGN PATENT DOCUMENTS

| | | |
|---|---|---|
| 2256005 | 7/1975 | France . |
| 2387100 | 4/1978 | France . |
| 2622578 | 1/1977 | Germany . |

*Primary Examiner*—James G. Smith
*Attorney, Agent, or Firm*—R. Craig Armstrong

[57] ABSTRACT

A striking tool has an elongated metal core having a bottom end for contacting a workpiece and an upper end for receiving the impact of a hammer or the like, and a plastic overlay secured around a substantial portion of the core, with at least a portion of the upper end of the core extending beyond the plastic overlay. The plastic overlay includes a grip area and a deflector flange extending a substantial distance outwardly above the grip area so as to protect a user's hand. The deflector flange comprises, in a first embodiment, a first deflector tier and a second deflector tier positioned below the first tier. Preferably, there are several angled ribs spaced radially around the plastic overlay, extending from the first tier, and then downwardly and outwardly to an outer edge of the second tier, to aid in deflecting errant hammer blows away from the user's hand.

10 Claims, 8 Drawing Sheets

STRIKING TOOLS WITH DEFLECTOR GRIPS

This is a continuation-in-part of U.S. patent Ser. No. 08/796,066 filed Feb. 4, 1997, now abandoned.

BACKGROUND OF THE INVENTION

This invention relates to hand tools, and more particularly to "striking tools" such as pin punches, cold chisels, nail sets, center punches, leather punches, drifts, etc., i.e. tools which are designed to be struck at one end, typically by a hammer, to transmit the force of the blow at the other end. More specifically, this invention relates to a deflector grip for such tools that will protect the user's hand from errant blows of the hammer.

There have been attempts to provide striking tools that incorporate a deflector feature. U.S. Pat. No. 4,133,362 discloses a complex protective guard means on a striking tool. The structure disclosed is not optimally designed to actually deflect the blow away from the user's hand. Instead, the structure disclosed is directed to absorb the impact of an errant blow.

Some traditional tools have deflector means that lack structural strength to actually deflect an errant hammer blow. Moreover, those traditional tools that had a resilient deflector, lacked a balanced weight design and/or had a bulky deflector that undesirably added additional weight to the tool. The result was a grossly disproportionate heavier top portion and a lighter bottom portion. These designs also suffered in that the combination of the deflector and striking tool lacked a truly integrated design. Finally, prior deflector designs restricted a clean view of the tool bottom end's alignment with the workpiece.

In the application of striking tools, there is always a need for a good gripping surface for the user. Finally, there is a cost motivation for desiring a simple design that would not incur significant additional manufacturing costs for the striking tool.

SUMMARY OF THE INVENTION

It is an object of the invention to overcome some of the drawbacks of traditional striking tools with deflectors.

It is an object of the invention to provide a deflector design to deflect the errant blow of a hammer away from the user's hand.

It is another object of the invention to provide a good grip for the user and which protects the user's hand from errant blows.

In accordance with the present invention, there is provided a striking tool having an elongated metal core with a bottom end for contacting a workpiece and an upper end for receiving the impact of a hammer or the like, and a plastic overlay secured around a substantial portion of the core, with at least a portion of the upper end of the core extending beyond the plastic overlay. The plastic overlay includes a grip area and a flange. In a first embodiment, the flange comprises a first deflector tier surface and a second deflector tier surface positioned below the first deflector tier surface. The second tier extends a substantial distance radially outward above the grip area so as to protect a user's hand.

Preferably in the first embodiment, there are several angled or curved ribs spaced radially around the plastic overlay, extending from an outer periphery of the first tier, and thence downwardly and outwardly to an outer edge of the second tier, to aid in deflecting errant hammer blows away from the user's hand.

In a second embodiment of the invention, the flange comprises a single deflector tier having a curved ribbed portion adapted onto the deflecting side of the tier, extending from the top of the plastic overlay, and thence downwardly and outwardly to an outer edge of the deflector tier.

Additional features of the invention will be described or will become apparent in the course of the following detailed description.

BRIEF DESCRIPTION OF THE DRAWINGS

The invention will now be described in detail, with reference to the accompanying drawings by way of example only, in which.

DETAILED DESCRIPTION

Figure 1:
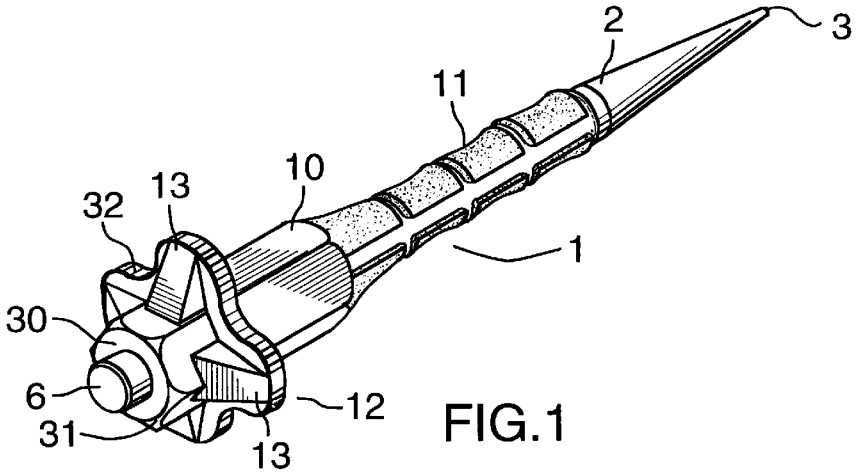
FIG. 1 is a perspective view of the preferred embodiment of a nail set.

Traditionally, pin punches and other striking tools are manufactured from square or hexagon bar stock to provide a grip and to prevent turning when striking and resist rolling when placed on a flat surface.

FIGS. 1–13 show a nail set 1 according to the first embodiment of the invention, which has a core 2 having a bottom end 3 for contacting nails or other workpieces, a coined area 4 with an aperture 5 through which the plastic can pass, advantageously, for better security, and an upper end 6 for receiving the impact of a hammer or the like.

In the invention, a center core 2 is manufactured from preferably round bar stock, or hex stock that has been machined or swaging processed to a size of a desired pin punch, cold chisel, nail set, center punch, leather punch, or drift. Once processing is complete the blank is coined to provide a non-round area 4 to which can be molded a plastic sleeve 10 with a deflector flange, generally designated 12. Preferably, through the aperture of the coined area and the molded plastic, a hole 15 is pierced for hanging purposes. At time of coining, the head of the core may or may not be upset to provide a larger striking surface than the basic diameter of the stock material in order to compensate for the use of the smaller diameter material. The upsetting operation will be dependent on the application of the tool and will provide an equal or better striking surface than found in existing products. Prior to the molding of the plastic sleeve, the coined and upset blank is hardened to conform to required specifications.

Figure 2:
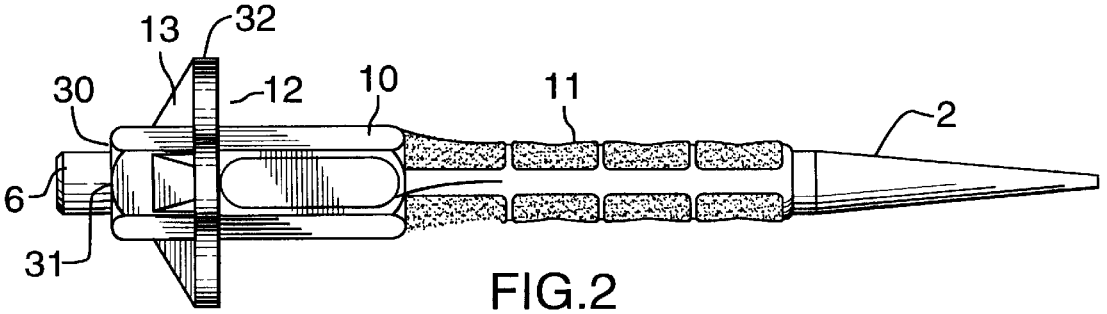
FIG. 2 is a first side view of the nail set.
Figure 3:
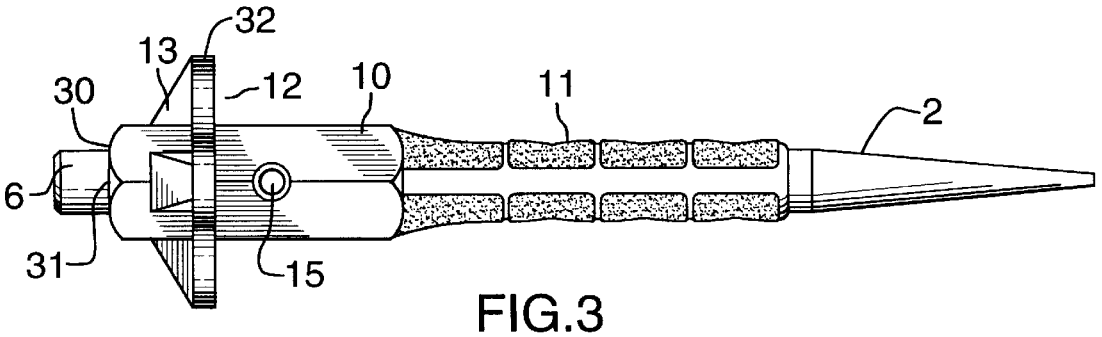
FIG. 3 is a second side view of the nail set, at ninety degrees to FIG. 2.
Figure 4:
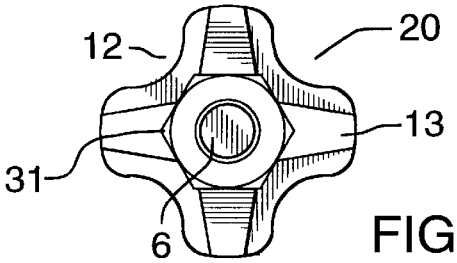
FIG. 4 is a top view of the nail set.

As shown in FIGS. 1–3, molded around or otherwise suitably secured to the core is a plastic overlay 10, which includes a grip area 11 and the protective defleclor flange 12. The grip area may be shaped and/or textured as desired, in order to provide a secure grip, the accompanying drawings illustrating several examples of such shaping and/or texturing. The upper end 6 should extend above the plane of the top of the plastic overlay, so that the hammer impacts directly on the upper end, and not on the plastic, both for greater durability and for more direct force transmission. As shown in FIGS. 4, 13, 15, and 23 the protective deflector flange 12 preferably includes notches or spaces 20 between adjacent ribs 13. The notches depend from the outer edge of the second tier and extend inwardly towards the axis of the core. The notches advantageously permits visual alignment of the tool bottom end 3 with the workpiece. As a result, the deflector flange design, advantageously, does not impede the basic utility of the striking tool.

Materials suitable for such a molding can selected based on properties which will provide a suitable gripping surface and will not fracture if accidentally struck. Suitable materials may include nylons, PVC, nylon/polypropylene composites, polyethylene, high impact polystyrene or ABS blends, vinyls, TPR (thermoplastic rubber) or any other sufficiently strong resin. In the preferred embodiment, the material is SANTOPRENE, which is a thermoplastic rubber compound.

Figure 12:
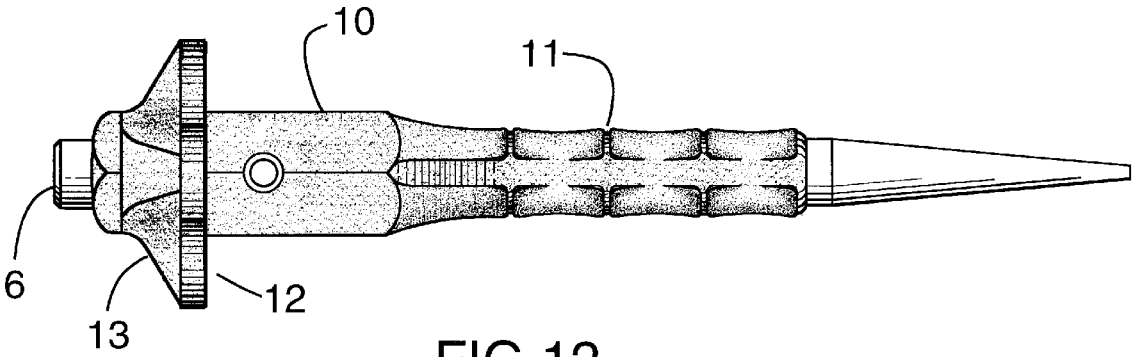
FIG. 12 is a side view of the nail set showing an alternative rib design.
Figure 14:
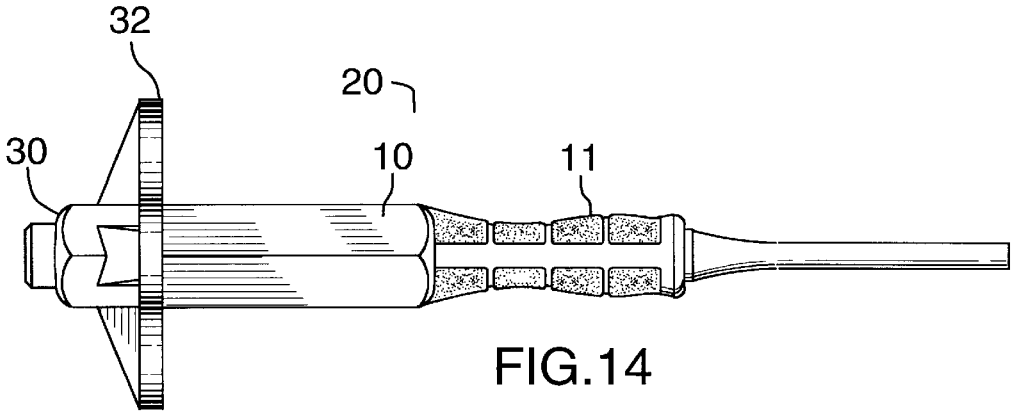
FIG. 14 is a side view of a preferred embodiment of a pin punch.
Figure 15:
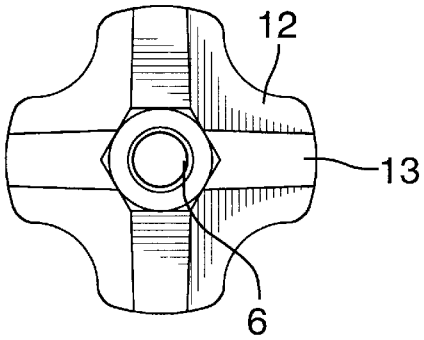
FIG. 15 is a top view of the pin punch.
Figure 16:
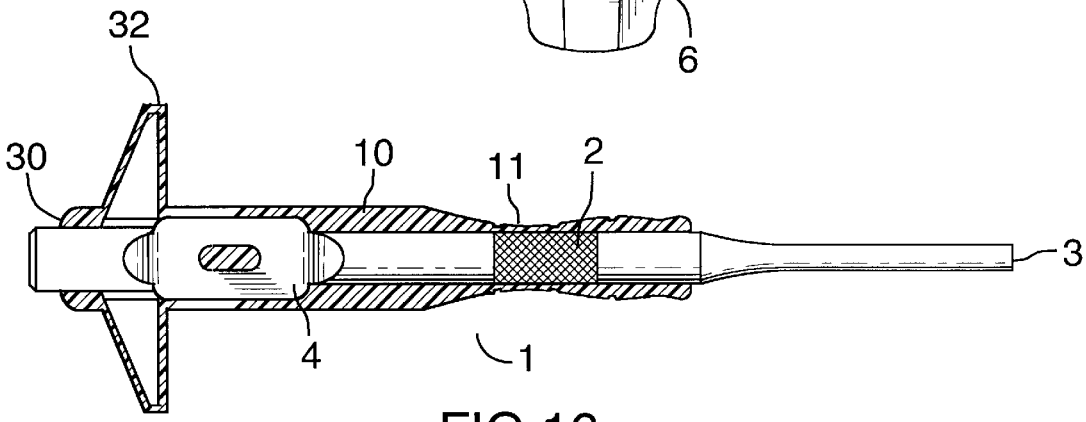
FIG. 16 is a partial cross-sectional side view of FIG. 14.
Figure 17:
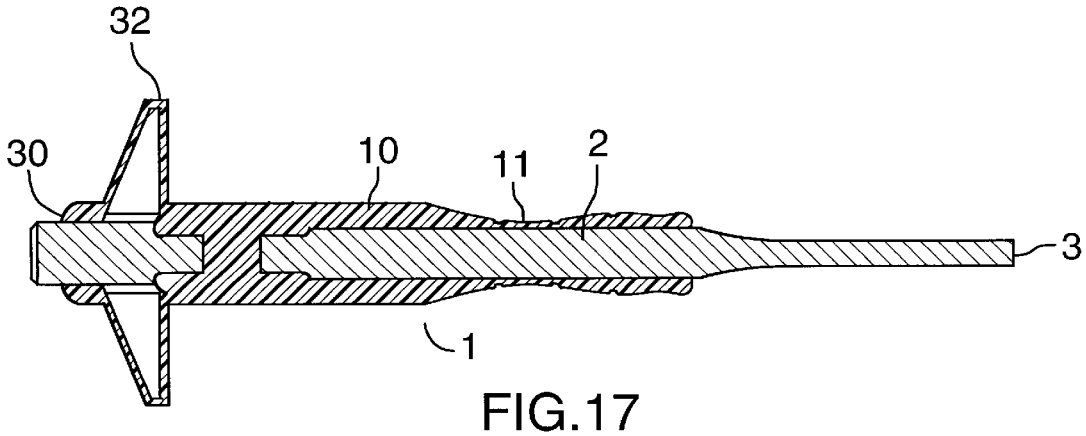
FIG. 17 is a full cross-sectional side view of FIG. 14, at ninety degrees thereto.

As shown in FIGS. 1–4, in the first embodiment, the deflector 12 comprises of two tiers. The two-tier deflector comprises a first deflector tier, generally designated 30, and a second deflector tier positioned below the first tier, generally designated 32. Both the first and second deflector tiers extend radially outward. The second deflector tier, however, extends out further than the first tier and extends a substantial distance outward so as to sufficiently protect a user's hand from an errant blow. The protective deflector flange preferably is supported, strengthened and protected against direct impact by several angled ribs 13 (there being four such ribs in a first preferred embodiment). The ribs are shaped so as to encourage the deflection of an errant hammer away from the user's hands. As shown in FIGS. 3, 12, 14 the ribs, in the first embodiment, depending from some portion of the first tier and then extend downwardly and outwardly in a gradual sloping fashion. Advantageously, an errant blow will be naturally encouraged to deflect away from the tool and the user's hand as a result of the shape of the ribs. Additionally, the ribs, advantageously, provide structural support for the flange to prevent undesirable deflection of the flange when an errant blow strikes thereon. The ribs, therefore, allow for a reduction of the thickness traditionally required in deflectors. As result, the weight of the flange is, advantageously, reduced. The two-tier structure for the deflector flange advantageously allows for an errant blow of a hammer to deflect away from the user's hand at two different levels. Since most errant blows slightly miss the striking head, the first deflector tier, which is nearest to the striking head of the two deflector tiers, usually receives the first impact of an errant blow. In this situation, when the errant blow is weak, the blow is dejected away sufficiently from the tool once the hammer strikes the first tier. The upper periphery of the first tier has, preferably, a bevelled edge 31 so as to further encourage an errant blow to deflect away from the tool and the user's hand. In circumstances when the errant blow is strong, the blow after striking the first deflector tier may then be deflected onto the second deflector tier. The second tier then in turn deflects the blow away from the tool once the hammer strikes the second tier or the ribs disposed thereon. Advantageously, the original amount of force of the errant blow would have been dampened by the deflection on the first tier before striking the second tier.

Figure 5:
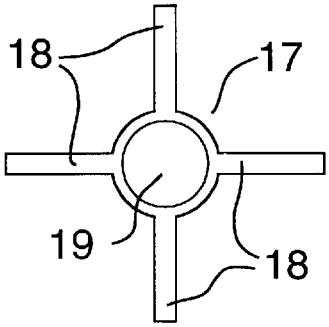
FIG. 5 is a top view of a reinforcement member.
Figure 6:
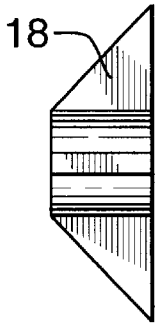
FIG. 6 is a side view of the reinforcement member.
Figure 9:
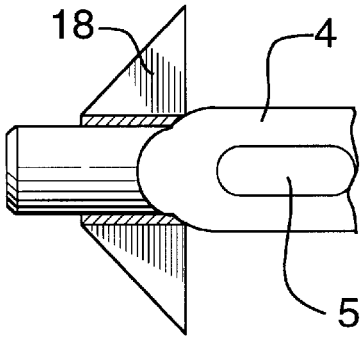
FIG. 9 is a view of a top portion of the core with the reinforcement member shown in cross-section.
Figure 7:
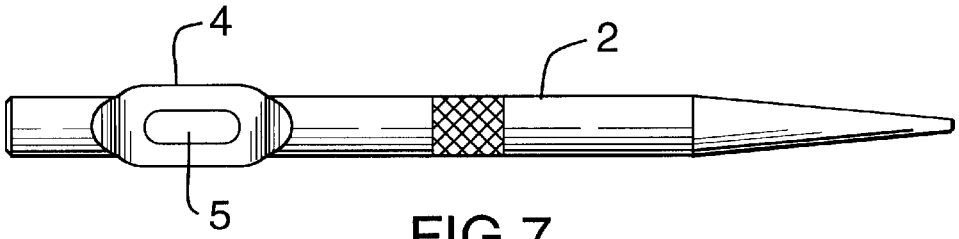
FIG. 7 is a side view of the core.
Figure 8:
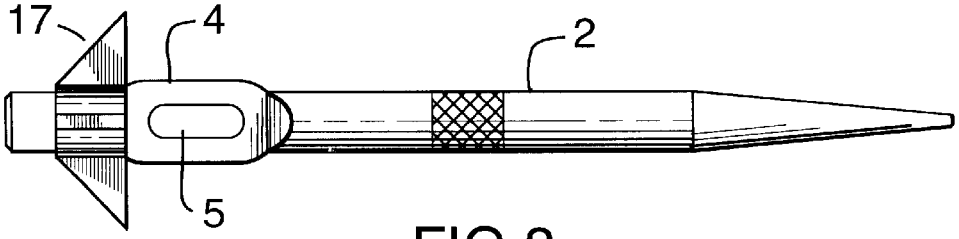
FIG. 8 is a side view of the core with the reinforcement member installed thereon.
Figure 10:
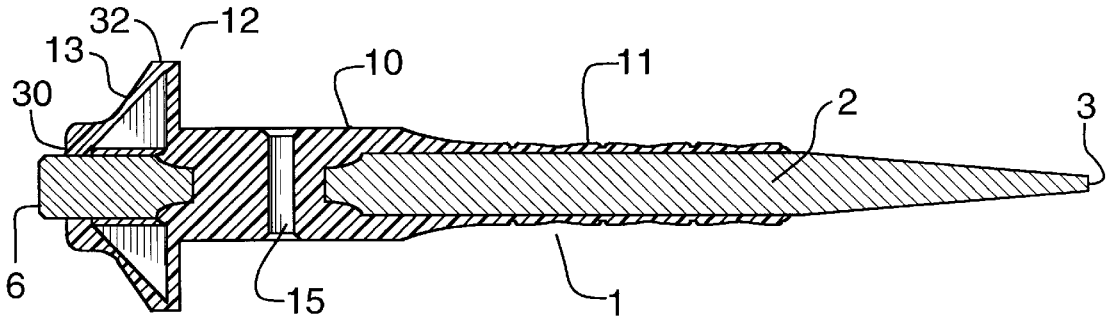
FIG. 10 is a cross-sectional view of FIG. 2 with a reinforcement member.
Figure 10A:
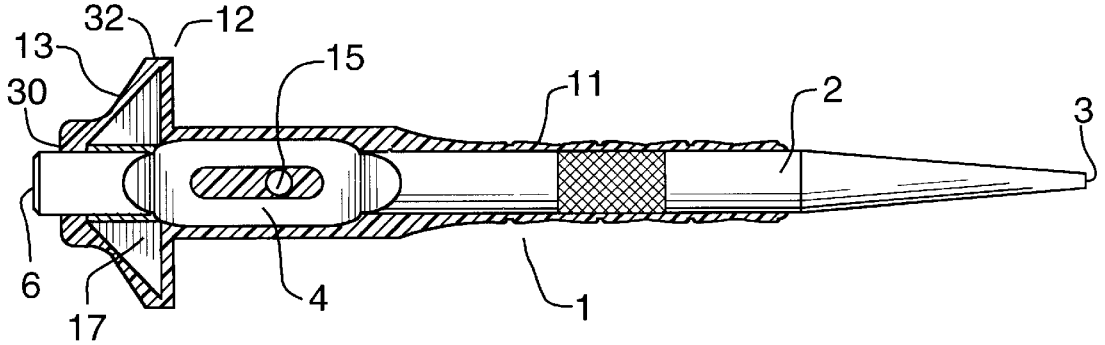
FIG. 10*a* is a partial cross-sectional view of FIG. 2, at ninety degrees thereto.
Figure 11:
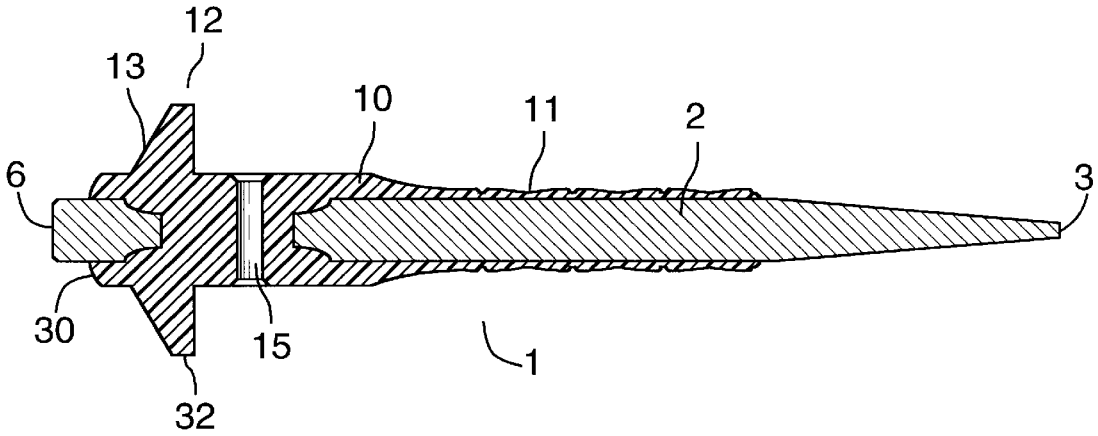
FIG. 11 is a similar view to FIG. 10, but without the reinforcement member.
Figure 11A:
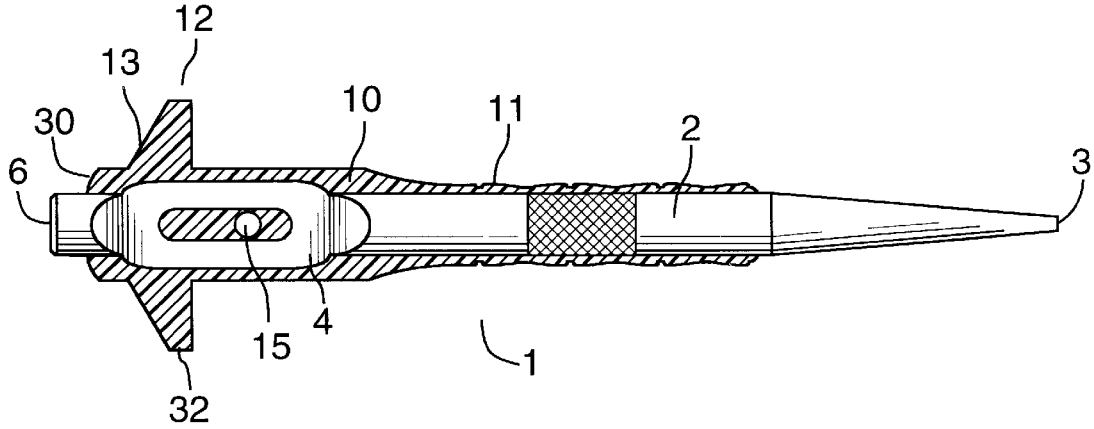
FIG. 11*a* is a similar view to FIG. 10*a*, but without the reinforcement member.

As shown in FIGS. 5 and 6, preferably with heavy duty tools, a reinforcement member 17 is introduced onto the core to add strength to the deflector collar. The reinforcement member rests on the upper shoulders of the coined area as best shown in FIG. 9. The reinforcement member includes arms 18 that outwardly radially extend from a central shaft. Various shapes for the arms may be utilized; however, the sloped arms shown in FIGS. 5–9 encourage, advantageously, the deflection of an errant blow of a hammer away from the user's hangs and interact well with the deflector flange designs. The shaft has an opening 19 extending therethrough. The opening is sized so as to accommodate the top diameter of the core, but is small enough to prevent the reinforcement member from sliding past the upper shoulder of the core. Advantageously, the reinforcement member provides additional strength to the deflector to assist the plastic sleeve in resisting deflection during an impact by a hammer. Moreover, the preferable two-piece design of the reinforcement member and the core facilitates simple manufacturing of the striking tool. As described earlier, the core may be manufactured from round bar stock, whereas the reinforcement member may be separately made from either hard plastic or metal.

Once complete, the reinforced core has directly molded to it the plastic sleeve and deflector flange described above which provides a non-rotating gripping surface with a square, hexagon or finger grip profile, for example, as well as a protective deflector flange intended to prevent injury should a glancing blow be made to the edge of the head.

FIGS. 14–17 show a pin punch 20, which is essentially very similar to the nail set of FIGS. 1–13.

Figure 18:
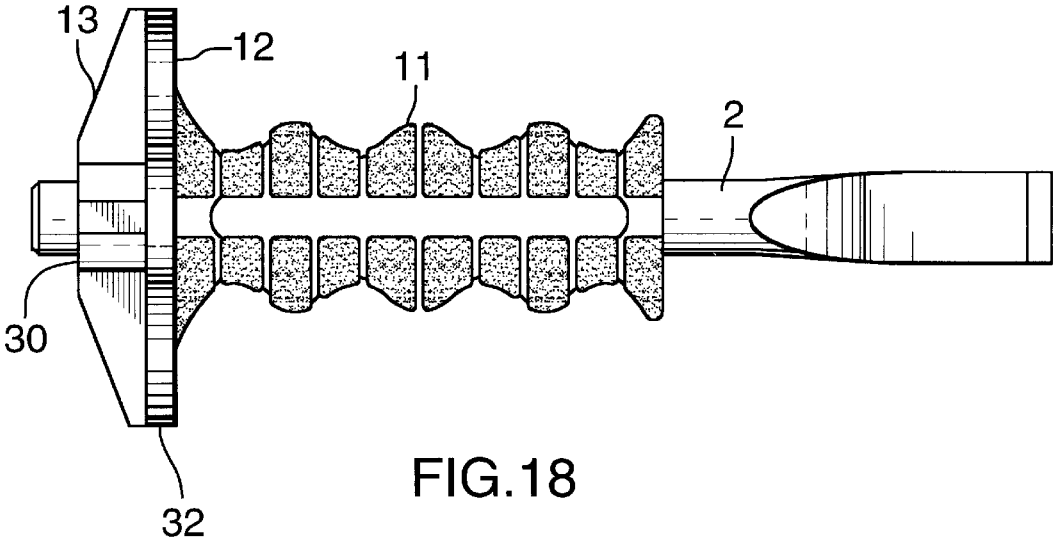
FIG. 18 is a side view of the preferred embodiment of a cold chisel.
Figure 19:
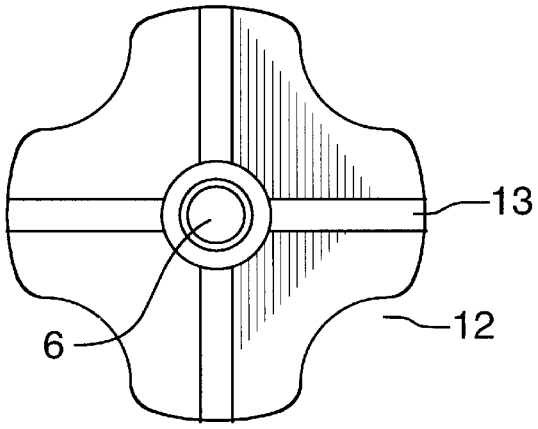
FIG. 19 is a top view of FIG. 18.
Figure 20:
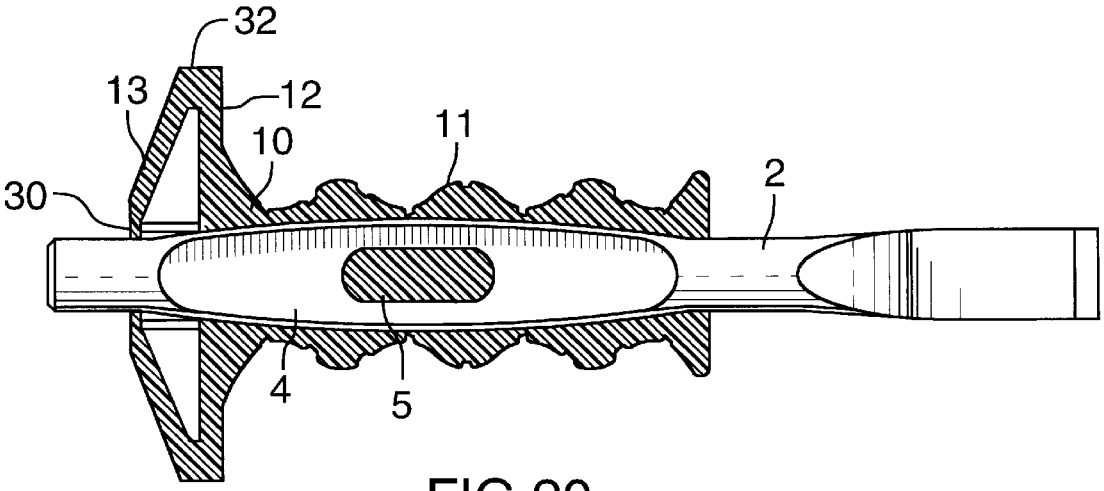
FIG. 20 is partial cross-sectional view of FIG. 18.

FIGS. 18–20 show a cold chisel 30, which again is similar to the nail set of FIGS. 1–13. The deflector flange in this embodiment of the invention has ribs that begin at the upper most outer periphery of the first tier.

Figure 13:
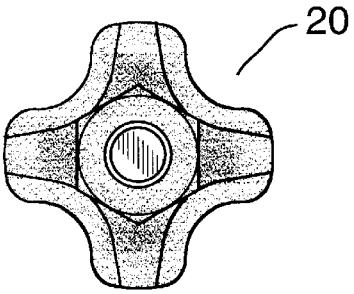
FIG. 13 is a top view of the nail set shown in FIG. 12.

FIGS. 12–13 show an alternative embodiment to the flange design.

Figure 21:
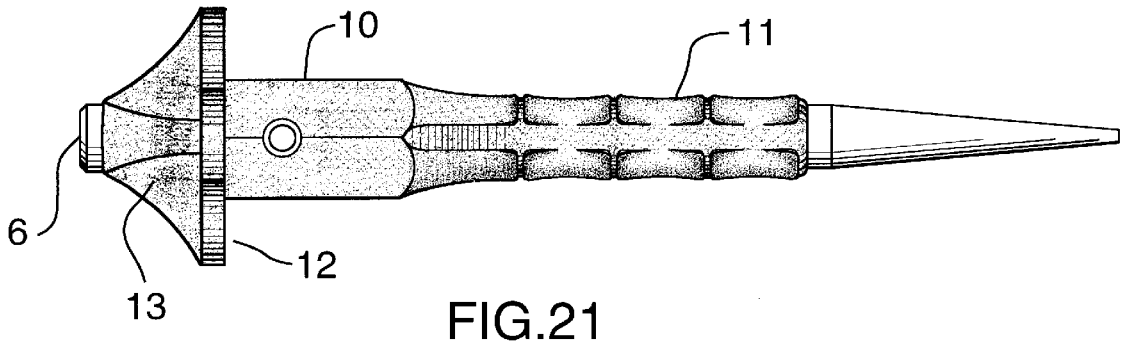
FIG. 21 is a side view of a preferred embodiment of a pin punch with the deflecting flange having a single deflector tier.
Figure 22:
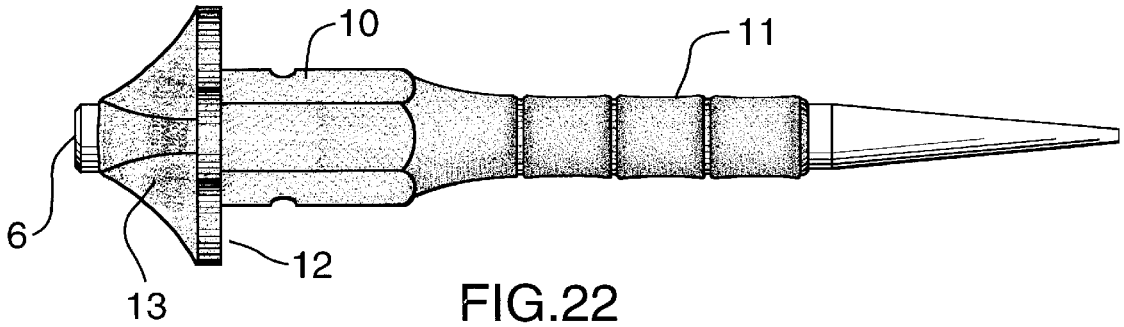
FIG. 22 is a second side view of FIG. 21, at ninety degrees thereto; and, FIG. 23 is a top view of FIG. 21.
Figure 23:
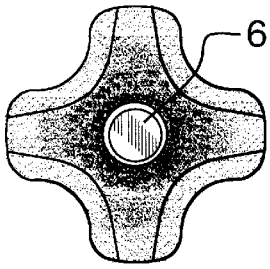

FIGS. 21–23 show a flange having a single deflector tier. In this second embodiment of the invention, the flange comprises a single deflector tier having a curved ribbed portion adapted onto the deflecting side of the tier, extending from the top of the plastic overlay, and thence downward and outwardly to an outer edge of the deflector tier. In this embodiment of the invention, many of the advantages described with respect to the first embodiment equally apply.

The invention provides striking tools which are substantially lighter than conventional striking tools, by virtue of a smaller diameter core being used, and which have a more positive and comfortable grip than traditionally found in the marketplace. The deflector flange also provides greater safety for the worker and reduces the likelihood of hand injuries.

What is claimed as the invention is:

1. A striking tool, comprising:

an elongated metal core having a bottom end for contacting a workpiece and an upper end for receiving the impact of an impact tool; and, a plastic overlay secured around a substantial portion of the core, with at least a portion of the upper end of the core extending beyond the plastic overlay, said plastic overlay including a grip area and a deflector flange extending a substantial distance outwardly above said grip area so as to protect a user's hand, said flange comprising a first deflector tier and a second deflector tier positioned below said first tier and extending radially outwardly further than said first tier.

2. A striking tool as recited in claim 1, further comprising a plurality of angled ribs spaced radially around said plastic overlay, extending from an upper region thereof, and thence downwardly and outwardly to an outer edge of said second tier.

3. A striking tool as recited in claim 2, a plurality of inwardly extending notches depending from an outer periphery of said second tier and spacing apart said ribs.

4. A striking tool as recited in claim 2, where there are four said ribs.

5. A striking tool as recited in claim 1, where said core has a coined portion with an aperture therethrough, through which plastic of said plastic overlay extends.

6. A striking tool as recited in claim 5, where a reinforcement member having an opening extending therethrough is positioned over a top of said core and rests on top shoulders of said coined portion.

7. A striking tool as recited in claim 1, where said tool is a nail set.

8. A striking tool as recited in claim 1, where said tool is a punch.

9. A striking tool as recited in claim 1, where said tool is a chisel.

10. A striking tool, comprising:

an elongated metal core having a bottom end for contacting a workpiece and an upper end for receiving the impact of an impact tool;

a plastic overlay secured around a substantial portion of the core, with at least a portion of the upper end of the core extending beyond the plastic overlay, said plastic overlay including a grip area and a deflector flange above said grip area;

said flange comprising a first deflector tier and a second deflector tier positioned below said first tier, said first and second tiers extending radially outwardly with respect to an axis of plastic overlay, and said second tier extending radially outwardly further than said first tier and extending a substantial distance outwardly from said grip area so as to protect a user's hand;

a plurality of spaced apart ribs depending from said first tier and extending downwardly to said second tier; and, a plurality of notches depending from an outer edge of said second tier extending inwardly towards said axis, each of said notches positioned between two adjacent ribs.

* * * * *